US007439831B2

(12) United States Patent
Ohno et al.

(10) Patent No.: US 7,439,831 B2
(45) Date of Patent: Oct. 21, 2008

(54) TRANSITION CIRCUIT

(75) Inventors: Araki Ohno, Tokyo (JP); Hideyuki Ohhashi, Tokyo (JP); Yukihiro Tahara, Tokyo (JP); Katsuhisa Kodama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 281 days.

(21) Appl. No.: 10/585,194

(22) PCT Filed: Feb. 27, 2004

(86) PCT No.: PCT/JP2004/002379

§ 371 (c)(1),
(2), (4) Date: Jul. 3, 2006

(87) PCT Pub. No.: WO2005/083832

PCT Pub. Date: Sep. 9, 2005

(65) Prior Publication Data

US 2007/0188258 A1 Aug. 16, 2007

(51) Int. Cl.
*H01P 1/00* (2006.01)

(52) U.S. Cl. ..... 333/248; 333/246

(58) Field of Classification Search ..... 333/245–248, 333/254

See application file for complete search history.

(56) References Cited

U.S. PATENT DOCUMENTS

| | | | | |
|---|---|---|---|---|
| 4,827,276 | A | 5/1989 | Fukuzawa et al. | |
| 6,060,959 | A | 5/2000 | Yakuwa | |
| 6,064,350 | A | 5/2000 | Uchimura et al. | |
| 6,483,480 | B1 * | 11/2002 | Sievenpiper et al. | 343/909 |
| 6,573,803 | B1 | 6/2003 | Ziegner et al. | |
| 6,628,242 | B1 | 9/2003 | Hacker et al. | |
| 7,136,029 | B2 * | 11/2006 | Ramprasad et al. | 343/909 |
| 2003/0076188 | A1 | 4/2003 | Dawn et al. | |
| 2005/0030137 | A1 * | 2/2005 | McKinzie et al. | 335/306 |
| 2008/0074324 | A1 * | 3/2008 | Puzella et al. | 343/700 MS |

FOREIGN PATENT DOCUMENTS

EP 0 253 128 A 1/1988

(Continued)

OTHER PUBLICATIONS

Qian et al., Microwave Journal, vol. 42, No. 1, pp. 66,68,70,72,74,76, (Jan. 1999). XP000902503.

(Continued)

*Primary Examiner*—Don P Le
(74) *Attorney, Agent, or Firm*—Birch, Stewart, Rolasch & Birch, LLP

(57) ABSTRACT

A transition circuit includes: a waveguide having a notched portion formed by cutting away a portion of the tube wall of the waveguide from the end portion of the waveguide; a dielectric substrate in which a portion extending outside the waveguide through the notched portion of the waveguide is formed; a plurality of polygonal conductor patterns formed regularly disposed on the dielectric substrate; a ground conductor formed on the dielectric substrate; through holes electrically connecting this ground conductor and each of the conductor patterns; an open stub formed on the dielectric substrate; and the conductor of a microwave transmission line, which is formed on the portion of the dielectric substrate, extending outside the waveguide, and which is electrically connected to the open stub.

19 Claims, 7 Drawing Sheets

FOREIGN PATENT DOCUMENTS

| | | | |
|---|---|---|---|
| EP | 0 893 842 | A2 | 1/1999 |
| EP | 1 304 762 | A2 | 4/2003 |
| JP | 6-140816 | A | 5/1994 |
| JP | 8-139504 | A | 5/1996 |
| JP | 2638985 | B2 | 4/1997 |
| JP | 11-103176 | A | 4/1999 |
| JP | 2001-203512 | A | 7/2001 |
| JP | 3208607 | B2 | 7/2001 |
| JP | 2002-208806 | A | 7/2002 |
| JP | 3464117 | B2 | 8/2003 |
| JP | 2003-273612 | A | 9/2003 |
| JP | 2003-332811 | A | 11/2003 |
| JP | 2005-109933 | A | 4/2005 |
| WO | WO-01/24313 | A1 | 4/2001 |

OTHER PUBLICATIONS

Deal et al., Microwave Journal, vol. 42, No. 7, pp. 128, 130, 132, 134, 136, 138, 140, 142, 144, (Jul. 1999). XP000920415.

* cited by examiner

TRANSITION CIRCUIT

TECHNICAL FIELD

The present invention relates to a transition circuit converting the transmission path of a high frequency such as a microwave or a millimeter wave from a waveguide to a microwave transmission line coupled thereto that is formed on a dielectric substrate.

BACKGROUND ART

For a transition circuit between a waveguide and a microwave transmission line formed on a dielectric substrate, there is a transition circuit as described in JP-A-6-140816, for example. With this transition circuit, a constructional example of a waveguide and a microstripline is shown.

In the conventional device described in the above literature, the dielectric substrate on which an open stub is formed is inserted into the waveguide through a notched portion formed by removing a portion of the side of the waveguide. At that time, the dielectric substrate is inserted thereinto such that a hollow is formed between the lower side of the dielectric substrate and the end face of the waveguide, thereby constructing the transition circuit.

In other words, when the microwave is inputted through the waveguide, the microwave is reflected by the end face of the hollow formed beneath the dielectric substrate. The phase of the reflected microwave has a phase sift of 180 degrees to the phase of the inputted microwave. For this reason, both the microwaves become in phase with each other at the location approximately ¼ wavelength away from the end face of the hollow in a direction axially of the tube of the waveguide, and strengthen each other by interference.

Therefore, the dielectric substrate on which the open stub is formed is inserted at the position approximately ¼ wavelength away from the end face of the hollow in a direction axially of the tube of the waveguide.

Thereby, the microwave transmitted from the open-stub side of the dielectric substrate placed within the waveguide, is transmitted to a conductor line portion, which is exposed outside the waveguide and is connected to this open stub, through the notched portion of the waveguide.

Consequently, the conductor line portion positioned outside the waveguide and connected to the open stub functions as a microwave transmission line, resulting in the transition of the transmission path of the inputted wave from the waveguide to the microwave transmission line formed on the dielectric substrate.

In this connection, the insertion of the dielectric substrate thereinto actually makes the position at which the incident wave and the reflected wave become in phase with each other to be deviated from the above-mentioned position; however, the proper adjustment for the position where both the waves become in phase makes the above-described device to operate as the transition circuit.

In the conventional transition circuit, there is a problem that the hollow is formed beneath the dielectric substrate projecting through the notched portion into the waveguide, thereby increasing the thickness in the circuit construction.

Moreover, there is a problem that if a multilayer dielectric substrate is used, wiring can not be carried out at all in the portion thereof which is inserted into the waveguide.

Further, there is a problem that when a through hole is made through the dielectric substrate and further, the notched portion of the waveguide sandwiches the substrate between the upper part and the lower part of the portion in order to construct the transition circuit, the occurrence of a misalignment between the positions of the upper and lower inner walls of the waveguide deteriorates the performance of the transition circuit itself.

The present invention has been accomplished to solve the above-mentioned problem. An object of the present invention is to provide a transition circuit the thickness of which can be reduced without the need for providing a particular hollow under the dielectric substrate. Furthermore, an object of the present invention is to provide a transition circuit in which a high-frequency line and lines for the power supply and the control signal can be wired in the lower layer of the dielectric substrate when a dielectric multilayer substrate is used.

DISCLOSURE OF THE INVENTION

The transition circuit according to the present invention includes: a waveguide having a notched portion formed by cutting away a portion of the tube wall of the waveguide from the end portion thereof; a dielectric substrate in which a portion extending outside the waveguide through the notched portion of the waveguide is formed, the substrate being coupled to the end portion of the waveguide; a plurality of polygonal conductor patterns formed regularly disposed on the face of the dielectric substrate, which is opposed to the interior of the waveguide; a ground conductor formed on the other face of the dielectric substrate; an electrically connecting portion electrically connecting the ground conductor and each of the conductor patterns; an open stub formed flush with the conductor patterns formed on the dielectric substrate; and a conductor line portion of a microwave transmission line, which is formed on the portion of the dielectric substrate that extends outside the waveguide, the conductor line portion being electrically connected to the open stub.

There is obtained an effect that the transition circuit can have a reduced thickness by having this construction without the need for providing a particular hollow under its dielectric substrate.

BEST MODE FOR CARRYING OUT THE INVENTION

An embodiment of the present invention will now be described by reference to the drawings in order to make description in further detail of the present invention.

Embodiment 1

Figure 1:
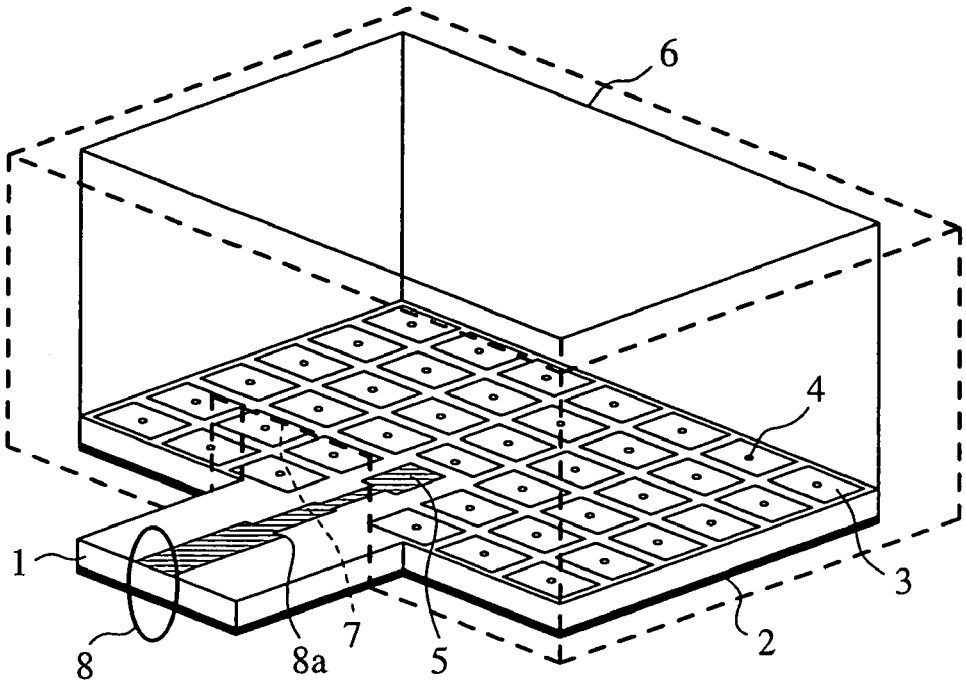
FIG. 1 is a view showing the construction of a transition circuit in accordance with Embodiment 1 of the present invention.

FIG. 1 is a view showing the construction of a transition circuit in accordance with Embodiment 1 of the present invention. Referring to the figure, a dielectric substrate 1 includes two conductor layers. A ground conductor 2 is the first conductor layer of the dielectric substrate 1. In the second conductor layer of the dielectric substrate 1, are regularly disposed a plurality of polygonal conductor patterns 3. In this embodiment, the conductor pattern is a square one.

The ground conductor 2, which is the first conductor layer of the dielectric substrate 1 and each of the polygonal conductor patterns 3, which are formed in the second conductor layer thereof, are electrically connected through a through hole (electrical connection portion) 4. An open stub 5 is formed flush with the conductor layer, in which the plurality of polygonal conductor patterns 3 are disposed, on the dielectric substrate 1, and the stub has a rectangular shape the width of which is changed in two stages.

The interval between the disposed conductor patterns 3 is determined from the shape and size of the pattern, the substrate thickness of the dielectric substrate 1, and the diameter of the through hole 4 such that the incident wave of a desired frequency and the reflected wave thereof from the ground conductor 2 become in phase with each other on the face of the dielectric substrate 1 on which the open stub 5 is formed.

A waveguide 6 uses the dielectric substrate 1 as the end face thereof, and is formed of a tube extending along a direction perpendicularly of the end face, the waveguide being provided with a notched portion 7 used for projecting a microwave transmission line 8 outwardly from the tube, through the side of the waveguide. The dielectric substrate 1 consists of a portion corresponding to the end face of the waveguide 6 and another portion extending outside the waveguide 6 through the notched portion 7, the two portions being integrally formed.

The open stub 5 formed in the conductor layer of the dielectric substrate 1 is connected to the conductor 8*a* of the microwave transmission line 8 formed on the extending portion of the dielectric substrate 1 through the notched portion 7 of the waveguide 6. The conductor 8*a* has a rectangular shape the width of which is changed in two stages.

The ground conductor 2 is formed in the entire first layer of the dielectric substrate 1 including the extending portion. The microwave transmission line 8 consists of the conductor 8*a* formed in the second conductor layer of the dielectric substrate 1 and the ground conductor 2 formed in the first layer of the dielectric substrate 1, which is located over the lower side of the dielectric substrate, and the microwave transmission line is also referred to as a microstripline.

The operation of the transition circuit will now be described as below when a microwave is inputted through the waveguide 6.

The microwave inputted through the waveguide 6 is reflected by the ground conductor 2 formed on the dielectric substrate 1 and the plurality of conductor patterns 3 regularly disposed thereon.

The conductor patterns 3 regularly disposed on the plane of the dielectric substrate 1 and the ground conductor 2 electrically connected with these patterns through the through holes 4 function as a magnetic wall making the incident wave and the reflected wave to be in phase at a specific frequency.

Here, the size of the conductor pattern 3, the interval between the adjacent conductor patterns 3, and the diameter of the through hole 4 are properly set in advance such that the incident wave and the reflected wave of the microwave of a desired frequency become in phase with each other on the top face of the open stub 5 formed on the dielectric substrate 1.

This construction converts the transmission path of the microwave from the waveguide 6 to the microwave transmission line 8 formed on the dielectric substrate 1 through the notched portion 7 of the waveguide 6.

The operation thereof will be described as below with specific examples.

Herein, it is assumed that the wavelength at a design center frequency f0 is λ0, one side of the square in which the conductor pattern 3 is shaped on the dielectric substrate 1 is approximately 0.17λ0, the diameter of the through hole 4 is approximately 0.02λ0, and the interval between the square conductor patterns 3 is approximately 0.01λ0.

Further, a substrate of relative dielectric constant 3.39 is used for the material of the dielectric substrate 1. Moreover, the thickness of the dielectric substrate 1, which is the distance between the square conductor pattern 3 and the ground conductor 2, is set to approximately 0.34λ0.

Figure 2:
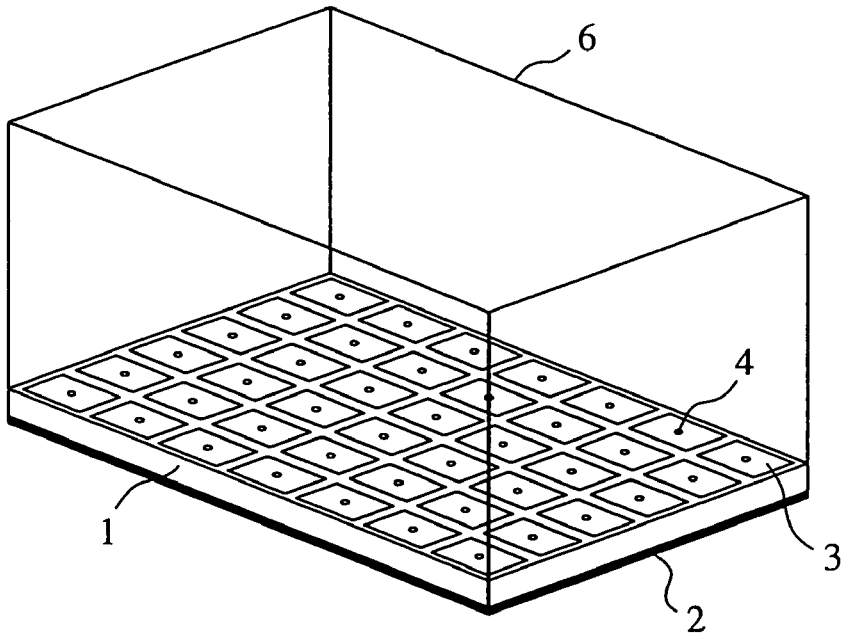
FIG. 2 is a view explaining the operation of the magnetic wall by the transition circuit in FIG. 1.
Figure 3:
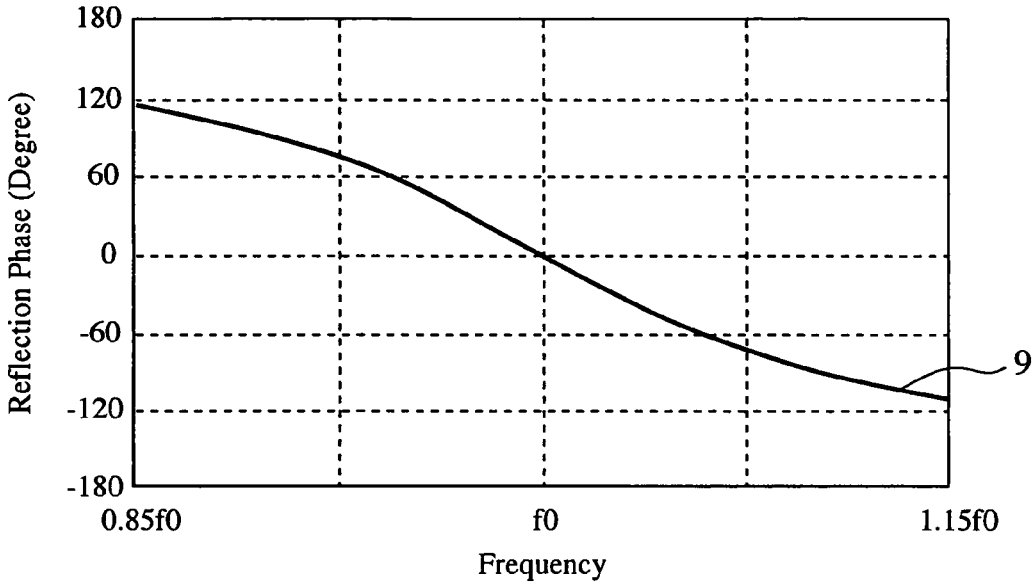
FIG. 3 is a graph showing the reflection phase characteristic of the dielectric substrate shown in FIG. 2 on its uppermost face.

FIG. 2 is a view explaining the operation of the magnetic wall by the transition circuit shown in the FIG. 1, the figure showing the transition circuit without the portion of the dielectric substrate 1 that extends from the waveguide 6, the notched portion 7 of the waveguide 6, and the microwave transmission line 8. FIG. 3 is a graph showing the reflection phase characteristic of the dielectric substrate 1 shown in FIG. 2 on its uppermost face.

In FIG. 3, as shown by the curve 9 showing the relationship between the reflection phase of the incident wave and the frequency thereof, each of the conductor patterns 3 regularly disposed thereon is electrically connected with the ground conductor 2 through the through hole 4 in this embodiment. This construction can operate as a magnetic wall because the reflection phase becomes approximately 0 degree at the design center frequency f0.

In addition, the plurality of conductor patterns 3 regularly disposed thereon have, as a whole, the shape that is cut to the dimensions of the inner wall of the waveguide 6, and the patterns are disposed to the edge of the dielectric substrate 1.

Figure 4:
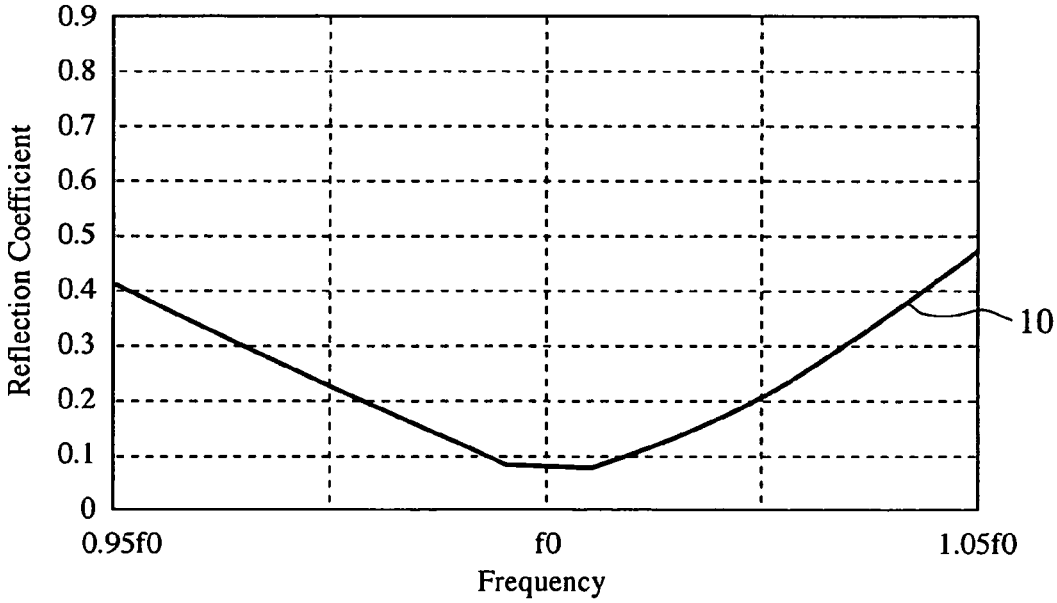
FIG. 4 is a graph showing the reflection characteristic of the transition circuit having conductor patterns 3 regularly disposed, shown in the FIG. 1.

FIG. 4 is a graph showing reflection characteristics of the transition circuit having the conductor patterns 3 regularly disposed in FIG. 1. In the transition circuit having the conductor patterns 3, as shown by the curve 10 showing the relationship between the reflection coefficient of the incident wave and the frequency thereof in FIG. 4, the reflection coefficient is the minimum at the design center frequency f0. This shows that the transmission path of the microwave inputted through the waveguide 6 is converted to the microwave transmission line 8 formed on the dielectric substrate 1, and the microwave is transmitted therethrough.

As described hereinabove, in accordance with Embodiment 1, the transition circuit includes: the waveguide 6 having the notched portion 7 formed by cutting away a portion of the tube wall thereof from the end portion thereof; the dielectric substrate 1 in which the portion extending outside the waveguide 6 through the notched portion 7 of the waveguide is formed; the plurality of polygonal conductor patterns 3 formed regularly disposed on the dielectric substrate 1; the ground conductor 2 formed on the dielectric substrate 1; the through holes 4 electrically connecting this ground conductor 2 and each of the conductor patterns 3; the open stub 5 formed on the dielectric substrate 1; and the conductor 8*a* of the microwave transmission line 8, which is formed on the portion of the dielectric substrate 1, extending outside the waveguide, and which is electrically connected to the open stub 5. Thereby, without providing a hollow between the lower side of the dielectric substrate 1 and the end face of the waveguide 6, the microwave propagating through the waveguide 6 can be transmitted to the microwave transmission line 8 formed on the dielectric substrate 1, and the microwave can be transmitted therethrough.

Moreover, in Embodiment 1, for each of the open stub 5 and the conductor 8*a* of the microwave transmission line 8 formed on the dielectric multilayer substrate 1, is used a rectangular conductor having a width changed in two stages; however, either or both of the stub and the conductor can have a uniform width.

In addition, the open stub 5 and the microwave transmission line 8 are formed by using a conductor having two or more types of widths, thereby enabling the frequency and the frequency band width to be adjusted by adjusting these widths.

Furthermore, needless to say, a dielectric multilayer substrate having n conductive layers therein (n is three or more) is used for the dielectric substrate 1, and two conductive layers randomly chosen therefrom are made to have the above-described construction, thereby enabling a transition circuit to be constructed.

For example, the circuit boards used for a microwave circuit, a power supply signal, or a control signal can be placed between the conductive layers of the dielectric substrate 1. In addition, when circuit boards are additionally provided under the ground conductor 2, used for the microwave, the power supply signal, and the control signal, the similar effect to that described hereinabove can be obtained.

Embodiment 2

In Embodiment 1, the example in which the transition circuit is constructed by use of two conductor layers formed on the dielectric substrate 1 is shown. In Embodiment 2, the dielectric substrate having three or more conductor layers is used to construct the transition circuit with two conductor layers arbitrarily selected therefrom. This construction can increase flexibility in the arrangement of layers in the dielectric substrate.

Figure 5:
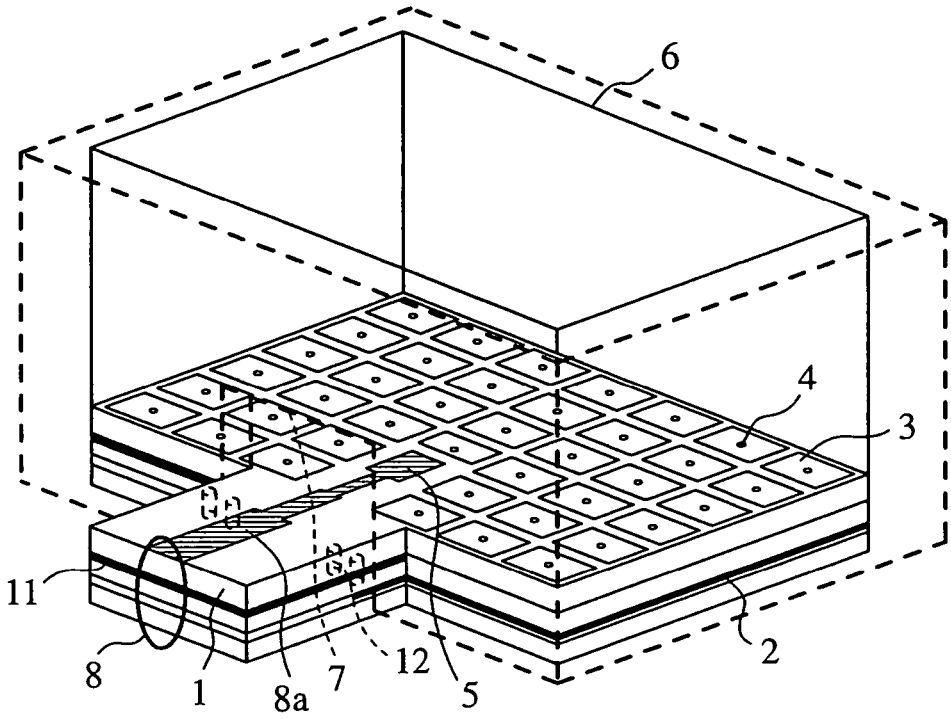
FIG. 5 is a view showing the construction of a transition circuit in accordance with Embodiment 2 of the present invention.

FIG. 5 is a view showing the construction of a transition circuit in accordance with Embodiment 2 of the present invention. In accordance with Embodiment 2, a multilayer substrate having three conductor layers therein is used for the dielectric substrate 1. The ground conductor 2 is formed in the first conductor layer, and the open stub 5 and the conductor patterns 3 are formed in the third conductor layer, which is the top layer.

In the second conductor layer disposed between the first conductor layer and the third conductor layer in the dielectric substrate 1, a second ground conductor 11 is formed only in the extending portion of the dielectric substrate 1, projecting from the waveguide 6. Further, the second ground conductor 11 is electrically connected with the ground conductor 2 through a plurality of through holes 12.

In Embodiment 2, the microwave transmission line 8 consists of the conductor 8*a* formed in the third conductor layer of the dielectric substrate 1 and the second ground conductor 11 electrically connected with the ground conductor 2 formed in the first conductor layer thereof, through the through holes 12.

Further, in Embodiment 2, the ground conductor 2 is formed not in the entire first conductor layer of the dielectric substrate 1 but only in the portion of the substrate, located within the waveguide 6 having the notched portion 7. In other words, the ground conductor 2 is not formed in the portion of the first conductor layer, corresponding to the portion of the dielectric substrate 1, projecting outside the waveguide 6. The construction thereof except this is similar to that shown in FIG. 1.

The operation thereof will now be described as below.

The microwave inputted through the waveguide 6 is reflected by the ground conductor 2 formed on the dielectric substrate 1 and the plurality of conductor patterns 3 regularly disposed thereon.

The conductor patterns 3 regularly disposed on the top face of the dielectric substrate 1 and the ground conductor 2 electrically connected with these patterns through the through holes 4 function as a magnetic wall making the incident wave and the reflected wave to be in phase with each other at a specific frequency.

Here, the size of the conductor pattern 3, the interval between the adjacent conductor patterns 3, and the diameter of the through hole 4 are properly set in advance such that the incident wave and the reflected wave of the microwave of a desired frequency are in phase with each other on the top face of the open stub 5 formed on the dielectric substrate 1.

This construction converts the transmission path of the microwave from the waveguide 6 to the microwave transmission line 8 on the dielectric substrate 1 through the notched portion 7 of the waveguide 6.

As mentioned above, in accordance with Embodiment 2, the microwave transmission line 8 has only to be formed by using either of the conductor layers of the dielectric multilayer substrate 1, thereby enabling the thickness of the dielectric substrate 1 to be freely set to the microwave transmission line 8. As a result, the microwave transmission line 8 having the conductor of the width, which is optimum for being manufactured, can be formed.

Moreover, also in Embodiment 2, a rectangular conductor having a width changed in two stages is used for the open stub 5 or the conductor 8*a* of the microwave transmission line 8 formed on the dielectric substrate 1; however, either or both of the stub and the conductor can have a uniform width.

Further, the open stub 5 and the microwave transmission line 8 are formed by using a conductor the width of which is changed in two or more times, thereby enabling the adjustment of the frequency and the frequency band width by adjusting these widths.

Furthermore, it goes without saying that a multilayer substrate having n conductive layers therein (n is four or more) is used for the dielectric substrate 1 and three conductive layers randomly chosen therefrom are made to have the above-described shape, thereby enabling the transition circuit to be formed.

Embodiment 3

In Embodiment 2, the example is shown in which the microwave transmission line 8 consists of the conductor 8*a* formed on the top face of the extending portion of the dielectric substrate 1, the ground conductor 2 formed in the first conductor layer on the dielectric substrate 1, and the second ground conductor 11.

In Embodiment 3, a new dielectric substrate is placed over the conductor 8*a* and the open stub 5 formed on the dielectric substrate 1. Further, on the top face of the dielectric substrate, which is newly laminated thereto, a new second ground conductor 13 is provided at the position where the second ground conductor is symmetrical to the ground conductor 2 formed on the dielectric substrate 1 with the conductor 8*a* formed on the dielectric substrate 1 as a reference plane. This ground conductor 13 and the ground conductor 2 are electrically connected by a plurality of through holes 11 to construct the microwave transmission line 8.

Figure 6:
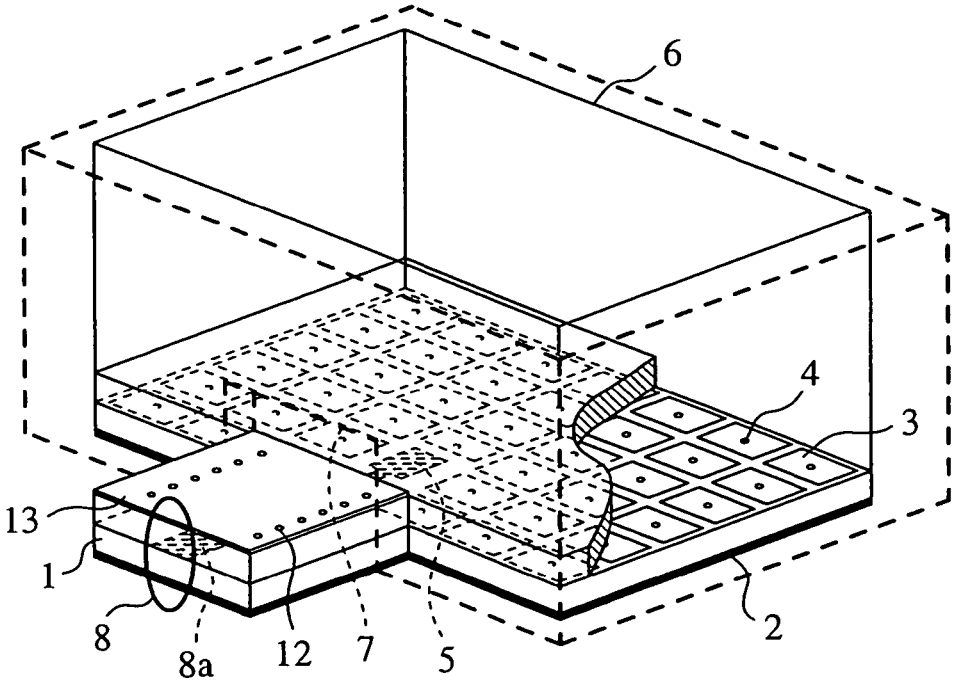
FIG. 6 is a view showing the construction of a transition circuit in accordance with Embodiment 3 of the present invention.

FIG. 6 is a view showing the construction of a transition circuit in accordance with Embodiment 3 of the present invention. In Embodiment 3, as the microwave transmission line 8, the transmission line referred to as a tri-plate line is formed of the ground conductor 13 and the ground conductor 2, which are provided vertically symmetrical to each other with the face of the conductor layer, in which the conductor 8*a* is formed, as the reference plane.

Similarly as in the case of the above-mentioned transition circuit, the size of the conductor pattern 3, the interval between the adjacent conductor patterns 3, and the diameter of the through hole 4 are properly set beforehand such that the reflection phase become 0 degree on the conductor layer in which the open stub 5 is formed.

This construction converts the transmission path of the microwave from the waveguide 6 to the microwave transmission line 8, which is the tri-plate line, through the notched portion 7 of the waveguide 6.

As mentioned hereinabove, in accordance with Embodiment 3, the radiation of a microwave toward the space above the microwave transmission line 8 and the coupling of a microwave with another microwave device through space can be suppressed. Moreover, similarly as in the case of the construction of the above-mentioned Embodiment, the dielectric substrate 1 can be provided on the end face of the waveguide 6, thereby enabling the thickness of the device to be reduced without the need for providing an extra space thereunder.

In addition, in Embodiment 3, the example is shown in which all the ground conductors 2 and 13 are connected through the through holes 12; however, the use of a conductive metal bonder (electrical connection portion) such as a screw, for example, in place of the through holes 12, can also produce the same effect.

Further, in Embodiment 3, the construction in which the dielectric substrate is laminated to the top of the open stub 5 is used; however, the construction in which the dielectric substrate is not provided on the open stub 5 may be employed. Furthermore, the construction in which a dielectric substrate is provided on the top and bottom, respectively, of the construction obtained in accordance with this embodiment can be also used.

Embodiment 4

Figure 7:
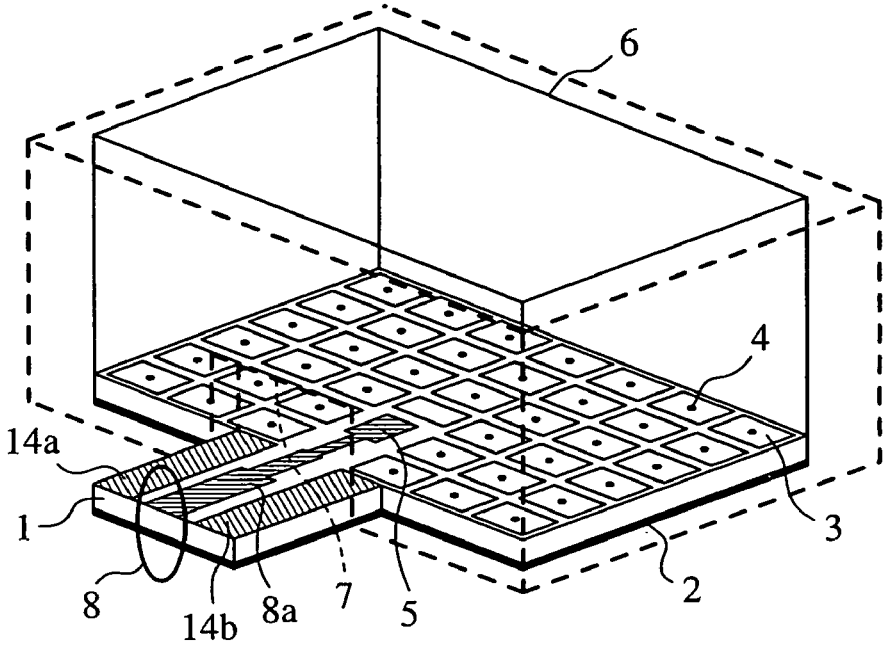
FIG. 7 is a view showing the construction of a transition circuit in accordance with Embodiment 4 of the present invention.

FIG. 7 is a view showing the construction of a transition circuit in accordance with Embodiment 4 of the present invention. In Embodiment 4, two different ground conductors 14*a* and 14*b* are provided flush with the conductor 8*a* formed in the second conductor layer of the dielectric substrate 1, on both sides of the conductor 8*a* at the positions symmetrical with respect to the axis of the conductor 8*a*, and spaced therefrom by a predetermined distance.

Thereby, a transmission line, which consists of the conductor 8*a* and the ground conductors 14*a* and 14*b*, and is referred to as a coplanar line, is constructed as the microwave transmission line 8.

The same parts as those in FIG. 1 are designated by similar numerals, and the repetitive explanations will be omitted.

The operation thereof will now be described as below.

The microwave inputted through the waveguide 6 is reflected by the ground conductor 2 formed on the dielectric substrate 1 and the plurality of conductor patterns 3 regularly disposed thereon.

The conductor patterns 3 regularly disposed on the top face of the dielectric substrate 1 and the ground conductor 2 electrically connected with these patterns through the through holes 4 work as a magnetic wall making the incident wave and the reflected wave thereof to be in phase with each other at a specific frequency.

Here, the size of the conductor pattern 3, the interval between the adjacent conductor patterns 3, and the diameter of the through hole 4 are properly set in advance such that the incident wave and the reflected wave of the microwave of a desired frequency are in phase with each other on the top face of the open stub 5 formed on the dielectric substrate 1.

This construction converts the transmission path of the microwave from the waveguide 6 to the microwave transmission line 8, which is a coplanar line, through the notched portion 7 of the waveguide 6.

As mentioned hereinabove, in accordance with Embodiment 4, the conductor layer, in which wiring required for connecting the circuits of microwave components such as resistors and integrated circuits with the ground conductors, when mounting these components, is formed, can be flush with the conductor 8*a* of the microwave transmission line B. Thereby, the wiring to be connected with the ground conductors can be easily carried out.

Moreover, in Embodiment 4, the microwave transmission line 8 is constructed in the form of a coplanar line, thereby eliminating the necessity of the through holes electrically connecting the ground conductor 2 formed on the bottom face (back side) of the dielectric substrate 1 and the ground conductors 14*a* and 14*b* formed on the top face (front side) thereof, which are necessary in above Embodiment 2 and Embodiment 3. This can further increase flexibility in the arrangement of wiring within the dielectric substrate 1.

Embodiment 5

Figure 8:
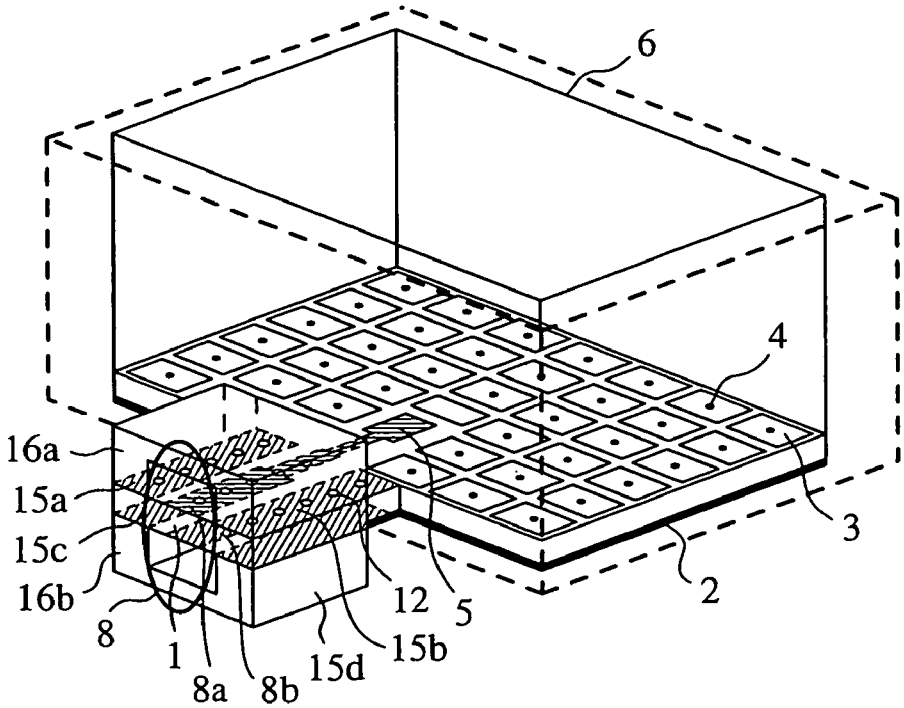
FIG. 8 is a view showing the construction of a transition circuit in accordance with Embodiment 5 of the present invention.

FIG. 8 is a view showing the construction of a transition circuit in accordance with Embodiment 5 of the present invention. In accordance with this embodiment, conductors 8*a* and 8*b* functioning as the microwave transmission line 8 are formed on the top face and bottom face, respectively, of the portion of the dielectric substrate 1, extending outside the waveguide 6.

Two different ground conductors 15*a* and 15*b* are provided flush with the conductor 8*a* on both sides of the conductor, at the positions symmetrical with respect to the axis of the conductor 8*a*, and spaced therefrom by a predetermined distance. Further, two different ground conductors 15*c* and 15*d* are provided flush with the conductor 8*b* on both sides of the conductor, at the positions symmetrical with respect to the axis of the conductor 8*b*, and spaced therefrom by a predetermined distance.

The conductors 8*a* and 8*b* are electrically connected to each other through the through holes 12, and the ground conductor 15*a* and the ground conductor 15*c*, and the ground conductor 15*b* and the ground conductor 15*d* are also electrically connected through the through holes 12, respectively.

Conductive external conductors 16*a* and 16*b* each having a concavity formed on the portion of the conductor, corresponding to the conductor 8*a* or 8*b*, perpendicularly to the dielectric substrate 1, are connected to the ground conductors 15*a*-15*d*, respectively, by using the areas of the dielectric substrate 1, in which the ground conductors 15*a*-15*d* are formed, as the allowance for connection therebetween.

Thereby, a transmission line, which consists of the conductors 8*a* and 8*b* and the ground conductors 15*a*-15*d*, and which is referred to as a suspended line, is constructed as the microwave transmission line 8. The same parts as those in FIG. 1 are designated by similar numerals, and the repetitive explanations will be omitted.

The operation thereof will now be described as below.

The microwave inputted through the waveguide 6 is reflected by the ground conductor 2 formed on the dielectric substrate 1 and the plurality of conductor patterns 3 regularly disposed thereon.

The conductor patterns 3 regularly disposed on the top face of the dielectric substrate 1 and the ground conductor 2 electrically connected with these patterns through the through holes 4 work as a magnetic wall making the incident wave and the reflected wave to be in phase with each other at a specific frequency.

Here, the size of the conductor pattern 3, the interval between the adjacent conductor patterns 3, and the diameter of the through hole 4 are properly set in advance such that the incident wave and the reflected wave of the microwave of a desired frequency are in phase with each other on the top face of the open stub 5 formed on the dielectric substrate 1.

This construction converts the transmission path of the microwave from the waveguide 6 to the microwave transmission line 8, which is a suspended line, through the notched portion 7 of the waveguide 6.

As mentioned above, in accordance with Embodiment 5, the transition of the microwave transmission path to the suspended line, which is a microwave transmission line of low loss, can be performed, that is, enabling the microwave transmission path to be converted to the transmission line, which is smaller and of lower loss than the waveguide when using the device in the long-range microwave transmission and in the high frequency band.

Embodiment 6

In the above-described Embodiments 1-5, the construction is shown in which the ground conductor 2, the conductor patterns 3, and the open stub 5 are disposed such that these parts are arranged within the area cut out by the inner wall of the waveguide 6.

Embodiment 6 shows a transition circuit in which the waveguide 6 is coupled to the uppermost face of the dielectric substrate 1.

Figure 9:
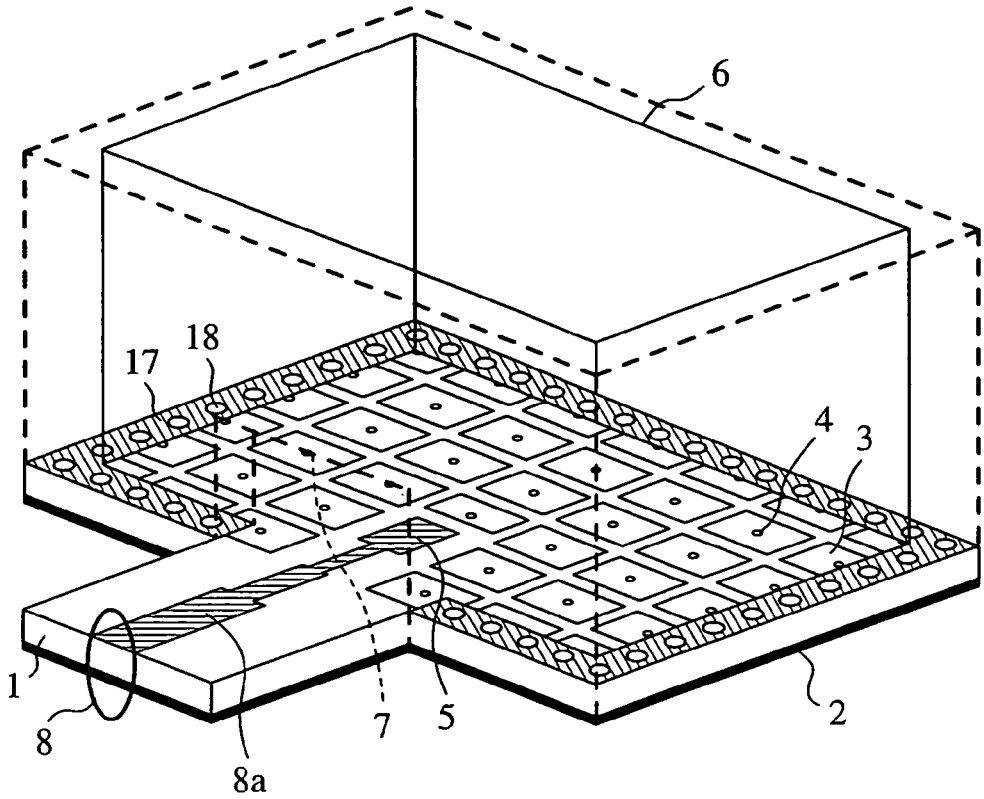
FIG. 9 is a view showing the construction of a transition circuit in accordance with Embodiment 6 of the present invention.

FIG. 9 is a view showing the construction of a transition circuit in accordance with Embodiment 6 of the present invention. A conductor 17 is formed on the connection allowance (the portion corresponding to the wall thickness of the waveguide 6) used for coupling the waveguide 6 to the uppermost face of the dielectric substrate 1. The conductor (the conductor pattern formed on the fringe of the dielectric substrate) 17 is electrically connected with the ground conductor 2 formed in the first conductor layer of the dielectric substrate 1 through a plurality of through holes 18. All of the diameters of the through holes 18 and the intervals therebetween do not have to be the same, and one or more of them may be different from the others.

Such coupling of the waveguide 6 to the top face of the dielectric substrate 1 can prevent a minute clearance from being formed between the side face of the dielectric substrate 1 and the inner wall of the waveguide 6. The same parts as those in FIG. 1 are designated by similar numerals, and the repetitive explanations will be omitted.

The operation thereof will now be described as below.

The microwave inputted through the waveguide 6 is reflected by the ground conductor 2 formed on the dielectric substrate 1 and the plurality of conductor patterns 3 regularly disposed thereon.

The conductor patterns 3 regularly disposed on the top face of the dielectric substrate 1 and the ground conductor 2 electrically connected with these patterns through the through holes 4 function as a magnetic wall making the incident wave and the reflected wave to be in phase with each other at a specific frequency.

Here, the size of the conductor pattern 3, the interval between the adjacent conductor patterns 3, and the diameter of the through hole 4 are properly set beforehand such that the incident wave and the reflected wave of the microwave of a desired frequency are in phase with each other on the top face of the open stub 5 formed on the dielectric substrate 1.

Moreover, in the conductor 17, the distance from the inner wall of the waveguide 6 to the position at which a plurality of through holes 18 are aligned (the distance between the face longitudinally traversing the aligned through holes 18 and the inner wall of the waveguide) is properly selected, thereby enabling the impedance of the waveguide 6 to be changed by using the through holes 18. This also enables the frequency characteristics of the transition circuit in accordance with this embodiment to be set to a desired value.

The construction described hereinabove converts the transmission path of the microwave from the waveguide 6 to the microwave transmission line 8 formed on the dielectric substrate 1 through the notched portion 7 of the waveguide 6.

Further, the through holes 18 are aligned in positional relation to the inner wall of the waveguide 6, for example, at the position at which the face longitudinally traversing the aligned through holes 18 circumscribes the inner wall side of the waveguide 6. This construction can substantially equalize the converting characteristics of the transition circuit having the waveguide 6 provided within the dielectric substrate 1 to that of the transition circuit constructed by disposing the dielectric substrate 1 within the waveguide 6. As a result, the effect similar to the hereinabove-mentioned construction can be achieved.

As the other positional relation therebetween, the through holes 18 are aligned at the position at which the face longitudinally traversing the aligned through holes is spaced away from the face of the inner wall of the waveguide by the distance designed such that the frequency characteristics thereof is a desired value. Such arrangement can slightly increase the design tolerance thereof by the etching accuracy of the conductor patterns 3 formed on the dielectric substrate 1 and the machining accuracy of the waveguide 6.

In the positional relation, when a misalignment is caused in the connection portion between the dielectric substrate 1 and the waveguide 6, the distance to the position at which the through holes 18 are aligned can be reset to a value responding to the misalignment.

Further, the adjacent through holes 18 can be disposed so as to be equi-spaced. Thereby, the waveguide 6 provided within the dielectric substrate 1 can suppress the occurrence of the disturbance in the electromagnetic field.

As mentioned above, in accordance with Embodiment 6, the waveguide 6 is functionally formed by the plurality of through holes 18, thereby enabling the device to work similarly as in the case in which the construction on the dielectric substrate 1 is disposed so as to be arranged within the area cut out by the inner wall of the waveguide 6.

Moreover, in the embodiment described above, when employing the waveguide 6 formed of a tube of rectangular cross-section, the through holes may be disposed such that the distances between the faces longitudinally traversing the aligned through holes and the inner wall of the waveguide 6 are different from each other between the through holes 18 provided through the conductors 17 corresponding to the two sides of the waveguide 6 opposed to each other in the rectangular cross-section of the waveguide and the through holes 18 provided through the conductors 17 corresponding to the two sides thereof each making a right angle with the above-described sides.

This construction can make the degree of influence on the performance degradation relating to the positional relation between the open stub 5 formed on the dielectric substrate 1 and the waveguide 6 to be different from each other between the two sides making a right angle in the cross-section of the waveguide. Thereby, the slight increase of the misalignment tolerance toward the direction of insensibility in the performance degradation can enhance the formability of the transition circuit of the present invention.

Additionally, the use of a conductive metal bonder such as a screw, for example, in place of the plurality of through holes 18, can also produce the same effect.

In addition, in the above-mentioned Embodiment 6, the example in which the microstripline is used as the microwave transmission line 8 is shown; however, the tri-plate line shown in Embodiment 3, the coplanar line shown in Embodiment 4, and the suspended line shown in Embodiment 5 can be also used.

Even in the case in which a variety of transmission lines mentioned above are employed, the portion of the dielectric substrate 1 serving as the "connection allowance" used for coupling the waveguide 6 thereto is provided with the conductor 17, and the conductor 17 and the ground conductor 2 are electrically connected by using the through holes 18 or the equivalent.

Embodiment 7

In Embodiments 1-6 described above, are shown the examples in which each of the conductor patterns formed on the uppermost face of the dielectric substrate 1 has the shape of a square.

In accordance with Embodiment 7, the device has the fundamentally same construction as that in above-mentioned Embodiments; however, the construction is different therefrom in that the conductor pattern has the shape of a triangle.

Figure 10:
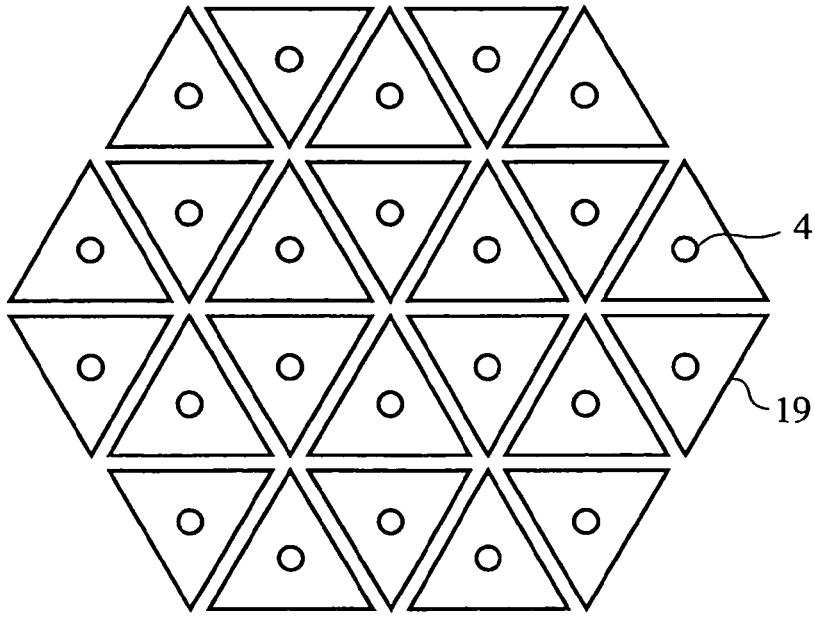
FIG. 10 is a view showing the shape of the conductor pattern used for the transition circuit in accordance with Embodiment 7 of the present invention and an example arrangement of the conductor patterns.

FIG. 10 is a view showing the shape of the conductor pattern used for the transition circuit in accordance with Embodiment 7 of the present invention and an example arrangement of the conductor patterns. In the example shown in the figure, the conductor patterns 19, each of which is given the shape of a regular triangle, are formed in the top conductive layer of the dielectric substrate 1. These conductor patterns 19 are electrically connected with the ground conductor 2 formed on the dielectric substrate 1 through the through holes 4.

The conductor patterns are disposed in such a manner that the vertex of the triangle and the base thereof are aligned in this order such that the distance between the adjacent conductor patterns 19 is the minimum.

Employment of the triangular conductor pattern for the conductor pattern 19 can easily achieve the arrangement in which the interval between the adjacent conductor patterns 19 is the minimum. Additionally, in the above description, the example in which the conductor patterns each having the shape of a regular triangle are used is shown; however, the conductor patterns each having the shape of another triangle produce the same effect.

Embodiment 8

Embodiment 8 has the fundamentally same construction as that in the aforementioned Embodiments 1-6; however, the construction is different therefrom in that each of the conductor patterns has the shape of a regular hexagon.

Figure 11:
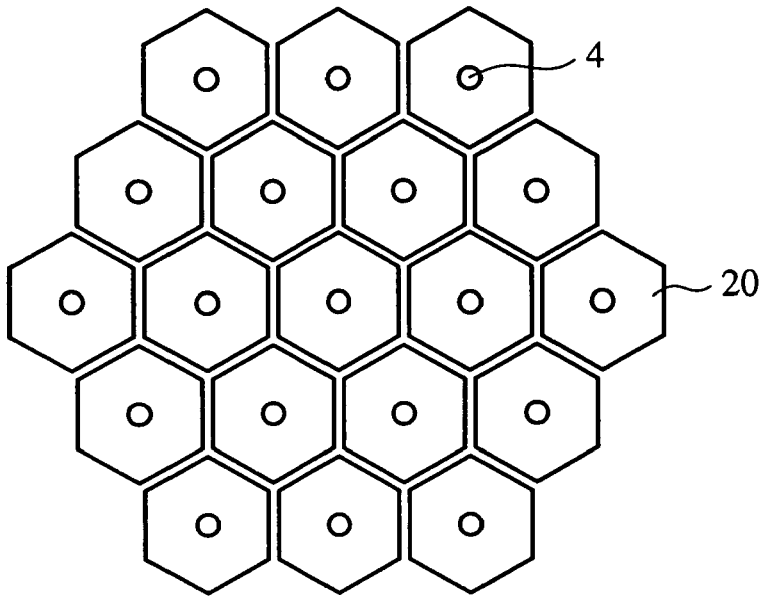
FIG. 11 is a view showing the shape of the conductor pattern 19 used for the transition circuit in accordance with Embodiment 8 of the present invention and an arrangement of the conductor patterns.

FIG. 11 is a view showing the shape of the conductor pattern 19 used for the transition circuit in accordance with Embodiment 8 of the present invention and an arrangement of the conductor patterns. In this embodiment, the conductor patterns 20, each of which is given the shape of a regular hexagon, are formed in the top conductive layer of the dielectric substrate 1. These conductor patterns 20 are electrically connected with the ground conductor 2 formed on the dielectric substrate 1 by the through holes 4. The conductor patterns 20 are disposed in such a manner that the side of the hexagon of the conductor pattern is opposed to that of the adjacent pattern such that the distance between the adjacent conductor patterns 20 is the minimum.

Regular hexagons form the shape that is the nearest to the shape of a circle when the hexagons are disposed so as to have the same positional relation, and thereby, the shape of the disposed hexagons has the feature that the difference in a cross-sectional direction is the smallest. As a result, when a waveguide of circular cross-section is used for the waveguide 6, the conductor patterns 20 can be uniformly disposed in a simple shape within the waveguide.

Thus, employment of the regular-hexagonal conductor pattern for the conductor pattern 20 can easily achieve the arrangement in which the interval between the adjacent conductor patterns 20 is the minimum also in the case in which the waveguide of circular cross-section is used.

Embodiment 9

Embodiment 9 has the fundamentally same construction as that in the above-mentioned Embodiments 1-6; however, this embodiment is different therefrom in that each of the conductor patterns formed on the dielectric substrate 1 has the shape of a rhombus.

Figure 12:
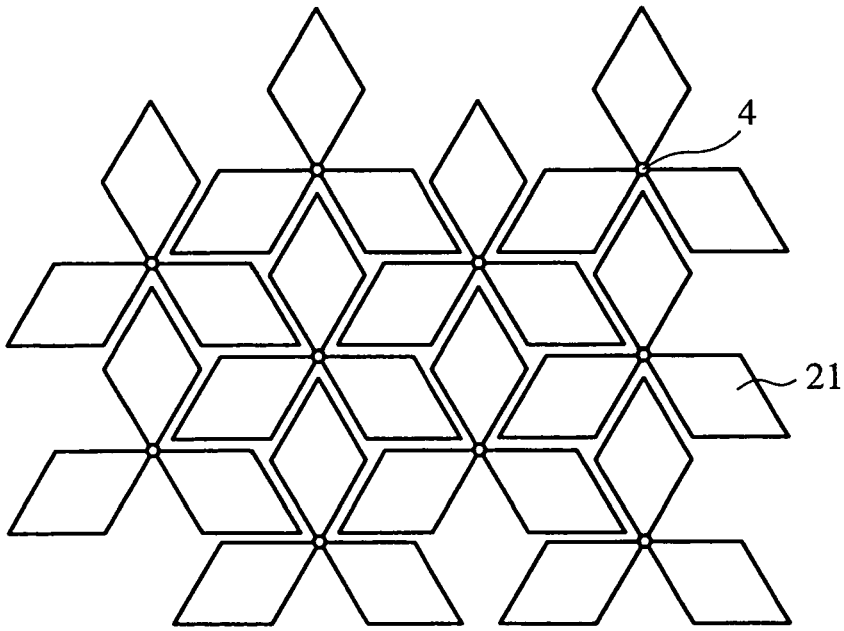
FIG. 12 is a view showing the shape of the conductor pattern used for the transition circuit in accordance with Embodiment 9 of the present invention and an arrangement of the conductor patterns.

FIG. 12 is a view showing the shape of the conductor pattern used for the transition circuit in accordance with Embodiment 9 of the present invention and an arrangement of the conductor patterns. As shown in the figure, in this embodiment, each of the conductor patterns 21 is given the shape of a rhombus, and each of the conductor patterns 21 is disposed 120 degrees rotated with the end point of the longer diagonal of the rhombus as the center.

In such a way, the pattern arrangement shown in the figure is formed in which the arrangement where three conductor patterns each having the shape of a rhombus are connected to each other at the end point of the longer diagonal thereof form one unit.

Furthermore, these conductor patterns 21 are electrically connected with the ground conductor 2 formed on the dielectric substrate 1 through the through holes 4. Here, the through hole 4 can be provided therethrough at the end point of the longer diagonal thereof as shown in the figure.

Thus, the conductor patterns each having the shape of a rhombus are used for the conductor patterns 21. Thereby, the area of the parallel arrangement between the adjacent conductor patterns increases, and the degree of flexibility in the adjustment of the characteristic of the device can increase by properly changing the size of the rhombus and the diameter of the through hole 4.

Embodiment 10

Embodiment 10 has the fundamentally same construction as those in the above-mentioned Embodiments 1-6; however, the construction thereof is different therefrom in that the conductor patterns formed on the dielectric substrate 1 consist of patterns having two types of shapes, a regular triangle and a regular hexagon.

Figure 13:
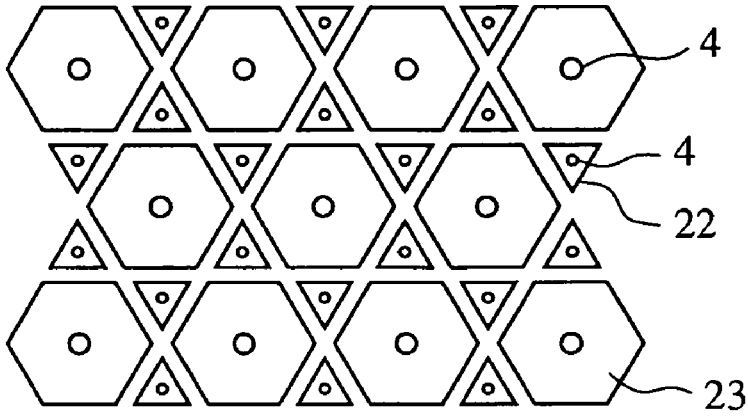
FIG. 13 is a view showing the shape of the conductor pattern used for the transition circuit in accordance with Embodiment 10 of the present invention and an arrangement of the conductor patterns.

FIG. 13 is a view showing the shapes of the conductor patterns used for the transition circuit in accordance with Embodiment 10 of the present invention and an arrangement of the conductor patterns. In this embodiment, the conductor patterns 22, each of which is given the shape of a regular triangle, and the conductor patterns 23, each of which is given the shape of a regular hexagon, are formed in the top conductive layer of the dielectric substrate 1.

The arrangement of the conductor patterns 23 of regular-hexagonal shape is different from that in above Embodiment 8, the conductor patterns being disposed such that the vertexes of the hexagons thereof are opposed to each other between the adjacent conductor patterns 23. The conductor patterns 22 of regular-triangular shape are disposed along the sides of the hexagon of each of the conductor patterns 23 such that the patterns 22 fill the interstices between the conductor patterns 23 disposed as described above.

These conductor patterns 22 and 23 are electrically connected with the ground conductor 2 formed on the dielectric substrate 1 through the through holes 4.

Such configuration enables the arrangement of the conductor patterns formed on the dielectric substrate 1 to have periodicity of two or more types at least, and thereby, can increase the degree of flexibility in the adjustment of the frequency characteristics.

Embodiment 11

In accordance with Embodiment 11, the device has the fundamentally same construction as that in above-mentioned Embodiments 1-6; however, the construction is different therefrom in that the conductor patterns formed on the dielectric substrate 1 consist of patterns having two types of shapes, a regular octagon and a regular quadrangle.

Figure 14:
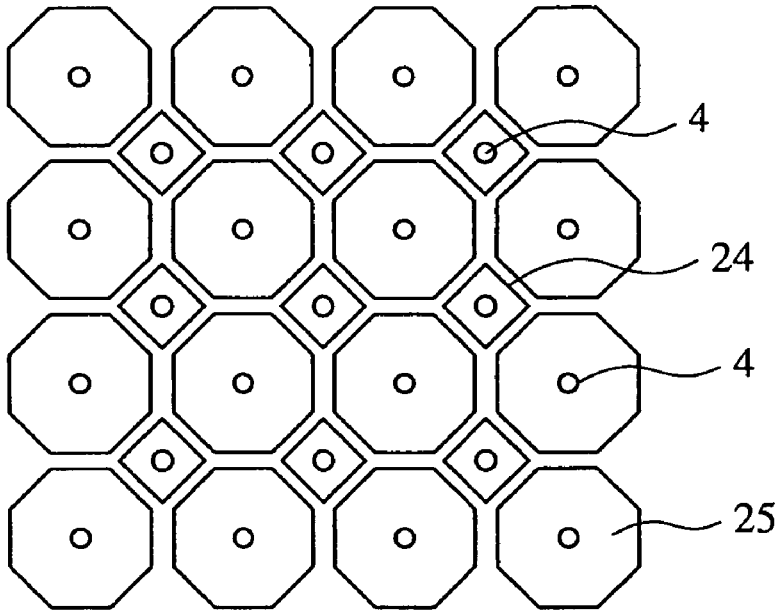
FIG. 14 is a view showing the shape of the conductor pattern used for the transition circuit in accordance with Embodiment 11 of the present invention and an arrangement of the conductor patterns.

FIG. 14 is a view showing the shapes of the conductor patterns used for the transition circuit in accordance with Embodiment 11 of the present invention and an arrangement of the conductor patterns. In this embodiment, the conductor patterns 24, each of which is given the shape of a regular quadrangle, and the conductor patterns 25, each of which is given the shape of a regular octagon, are formed in the top conductive layer of the dielectric substrate 1.

The conductor patterns 25 of regular-octagonal shape are disposed such that the sides of the octagons thereof are opposed to each other between the adjacent conductor patterns 25. The conductor patterns 24 of regular-quadrangular shape are disposed along the sides of the octagon of each of the conductor patterns 25 such that the patterns 24 fill the interstices between the conductor patterns 25 disposed as described above.

These conductor patterns 24 and 25 are electrically connected with the ground conductor 2 formed on the dielectric substrate 1 through the through holes 4.

Such configuration enables the arrangement of the conductor patterns formed on the dielectric substrate 1 to have periodicity of two or more types at least, and thereby, can increase the degree of flexibility in the adjustment of the frequency characteristics.

INDUSTRIAL APPLICABILITY

As mentioned hereinabove, the transition circuit according to the present invention includes: the waveguide having the notched portion formed by cutting away a portion of the tube wall thereof from the end portion thereof; the dielectric substrate in which the portion extending outside the waveguide through the notched portion of the waveguide is formed; the plurality of polygonal conductor patterns formed regularly disposed on the dielectric substrate; the ground conductor formed on the dielectric substrate; the through holes electrically connecting this ground conductor and each of the conductor patterns; the open stub formed on the dielectric substrate; and the conductor of the microwave transmission line, which is formed on the portion of the dielectric substrate, extending outside the waveguide, and which is electrically connected to the open stub. For this reason, the transition circuit is of low-profile, of high-density, of low-loss, and applicable to mobile communication systems and radar systems.

The invention claimed is:

1. A transition circuit converting the transmission path of a microwave in a direction either from a waveguide to a microwave transmission line or from a microwave transmission line to a waveguide, said transition circuit comprising:

a waveguide having a notched portion formed by cutting away a portion of the wall of the waveguide from the end portion thereof;

a dielectric substrate in which a portion extending outside the waveguide through the notched portion of the waveguide is formed, the substrate being coupled to the end portion of the waveguide;

a plurality of polygonal conductor patterns formed regularly disposed on the face of the dielectric substrate, which is opposed to the interior of the waveguide;

a ground conductor formed on the other face of the dielectric substrate;

an electrically connecting portion electrically connecting the ground conductor and each of the conductor patterns;

an open stub formed flush with the conductor patterns formed on the dielectric substrate; and a conductor line portion of a microwave transmission line, which is formed on the portion of the dielectric substrate that extends outside the waveguide, the conductor line portion being electrically connected to the open stub.

2. The transition circuit according to claim 1, wherein the dielectric substrate is formed of a dielectric multilayer substrate in which a circuit can be formed on other than the faces on which the ground conductor and the conductor patterns portion are formed.

3. The transition circuit according to claim 1, further comprising: a ground conductor formed between the face on which the other ground conductor is formed and the face on which the conductor patterns are formed, in the portion of the dielectric substrate that extends outside the waveguide; and an electrically connecting portion electrically connecting both of the ground conductors.

4. The transition circuit according to claim 1, further comprising: a dielectric substrate provided over the face of the dielectric substrate on which the conductor patterns are formed; a ground conductor formed on this dielectric substrate, and further, on the face thereof opposed to the face thereof contacting the conductor line portion formed in the portion thereof extending outside the waveguide; and an electrically connecting portion electrically connecting between the ground conductors including this ground conductor.

5. The transition circuit according to claim 1, wherein the microwave transmission line is formed of a coplanar line consisting of a conductor line portion formed on the dielectric substrate and ground conductors formed flush with this conductor line portion, along and on both sides of the conductor line portion.

6. The transition circuit according to claim 1, further comprising:

a conductor line portion of the microwave transmission line, formed on the face opposed to the face on which the other conductor line portion is formed, in the portion of the dielectric substrate that extends outside the waveguide;

two metal conductor portions each having a concavity formed thereon such that a gap is formed between the metal conductor portion and each of these conductor line portions formed on both faces of the substrate, each of the metal conductor portions being provided arranged to encompass the face on which the conductor line portion is formed, in the extending portion of the dielectric substrate; and an electrically connecting portion electrically connecting these metal conductor portions.

7. The transition circuit according to claim 1, wherein the open stub is formed of a conductor pattern of a shape having a width changed in a plurality of stages.

8. The transition circuit according to claim 1, wherein the conductor line portion of the microwave transmission line is formed of a conductor pattern of a shape having a width changed in a plurality of stages.

9. The transition circuit according to claim 1, wherein the end face of the waveguide is coupled to the face of the dielectric substrate, on which the conductor patterns are formed, and the transition circuit further comprises: a conductor pattern portion provided on the fringe of the dielectric substrate corresponding to the coupling allowance for coupling the waveguide to the dielectric substrate, and an electrically connecting portion electrically connecting this conductor portion and the ground conductor.

10. The transition circuit according to claim 9, wherein the electrically connecting portion electrically connecting the conductor pattern portion provided on the fringe of the dielectric substrate and the ground conductor consists of through holes, and further, the electrically connecting portion is disposed at the position at which the face longitudinally traversing the aligned through holes circumscribes the inner wall side of the waveguide.

11. The transition circuit according to claim 9, wherein the electrically connecting portion electrically connecting the conductor pattern portion provided on the fringe of the dielectric substrate and the ground conductor consists of through holes, and further, the electrically connecting portion is disposed at the position at which the face longitudinally traversing the aligned through holes is spaced away from the inner wall side of the waveguide.

12. The transition circuit according to claim 9, wherein the waveguide is formed of a tube having a rectangular cross section; and the electrically connecting portion electrically connecting the conductor pattern portion provided on the fringe of the dielectric substrate and the ground conductor consists of through holes, and further, is disposed such that, between the through holes aligned on the fringes thereof corresponding to the two sides of the waveguide opposed to each other in the rectangular cross section thereof and the through holes aligned on the other fringes corresponding to the two sides thereof each making a right angle with the above side, the distances between the face longitudinally traversing the aligned through holes and the inner wall of the waveguide are different from each other.

13. The transition circuit according to claim 9, wherein the electrically connecting portion electrically connecting the conductor pattern portion provided on the fringe of the dielectric substrate and the ground conductor consists of through holes, and further, the adjacent through holes are uniformly spaced.

14. The transition circuit according to claim 1, wherein each of the conductor patterns is formed of a conductor pattern having the shape of a regular triangle.

15. The transition circuit according to claim 1, wherein each of the conductor patterns is formed of a conductor pattern having the shape of a quadrangle.

16. The transition circuit according to claim 1, wherein each of the conductor patterns is formed of a conductor pattern having the shape of a regular hexagon.

17. The transition circuit according to claim 1, wherein the conductor patterns consist of conductor patterns of two or more types of shapes.

18. The transition circuit according to claim 17, wherein the conductor patterns consist of conductor patterns each having the shape of a regular triangle and conductor patterns each having the shape of a regular hexagon.

19. The transition circuit according to claim 17, wherein the conductor patterns consist of conductor patterns each having the shape of a quadrangle and conductor patterns each having the shape of an octagon.

* * * * *